United States Patent [19]

Adams et al.

[11] 4,029,216

[45] June 14, 1977

[54] METHOD AND APPARATUS FOR MOVING A STACK OF CORRUGATED SHEETS FROM A STACKER TO A DESIRED LOCUS

[75] Inventors: Clifton G. Adams, Baldwin Park; Carl B. Dallas, Buena Park; George E. Coltrin, El Monte, all of Calif.

[73] Assignee: Georgia-Pacific Corporation, Portland, Oreg.

[22] Filed: May 7, 1975

[21] Appl. No.: 575,204

[52] U.S. Cl. ..... 214/1 BB; 214/1 C; 214/6 BA; 214/8.5 G; 214/152; 93/93 C

[51] Int. Cl.[2] ..... B65G 47/90

[58] Field of Search ..... 214/152, 1 C, 8.5 R, 214/8.5 A, 8.5 C, 8.5 SS, 6 R, 8.5 G, 6 BA, 1 R, 1 BB, 730, 670; 294/DIG. 1, 87 R; 271/214, 141; 93/93 C

[56] References Cited

UNITED STATES PATENTS

| | | | |
|---|---|---|---|
| 3,187,917 | 6/1965 | Miller | 214/8.5 X |
| 3,834,290 | 9/1974 | Nelson | 214/6 BA X |

FOREIGN PATENTS OR APPLICATIONS

| | | | |
|---|---|---|---|
| 69,305 | 10/1969 | Germany | 214/8.5 C |
| 1,179,866 | 10/1964 | Germany | 214/8.5 R |

*Primary Examiner*—Frank E. Werner
*Attorney, Agent, or Firm*—Owen, Wickersham & Erickson

[57] ABSTRACT

A method and a machine for moving a stack of flat corrugated board sheets from a stacker to a delivery locus. A carriage is supported for fore-and-aft horizontal movement along a main frame and has a transverse frame member supported on said carriage for vertical movement, both the horizontal and vertical movement being power driven. A first series of vertical, horizontally perforated plates is secured against rotation to the transverse frame member, and a second series of vertical plates is supported so that they can be moved toward and away from the first plates by power means; the second plates have a series of horizontal pins projecting therefrom and aligned with the perforations through said first plates. When a desired number of corrugated board sheets have been stacked, the second plates are moved toward and against the first plates so as to project the pins into some of the flutes of the stacked corrugated board sheets, including a substantial number of flutes of the bottommost sheet and a substantial number of flutes in other sheets. Then the stack may be lifted and moved to a desired location and there stripped from the pins.

17 Claims, 13 Drawing Figures

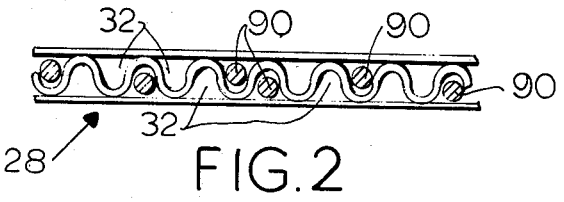
FIG. 2
FIG. 1
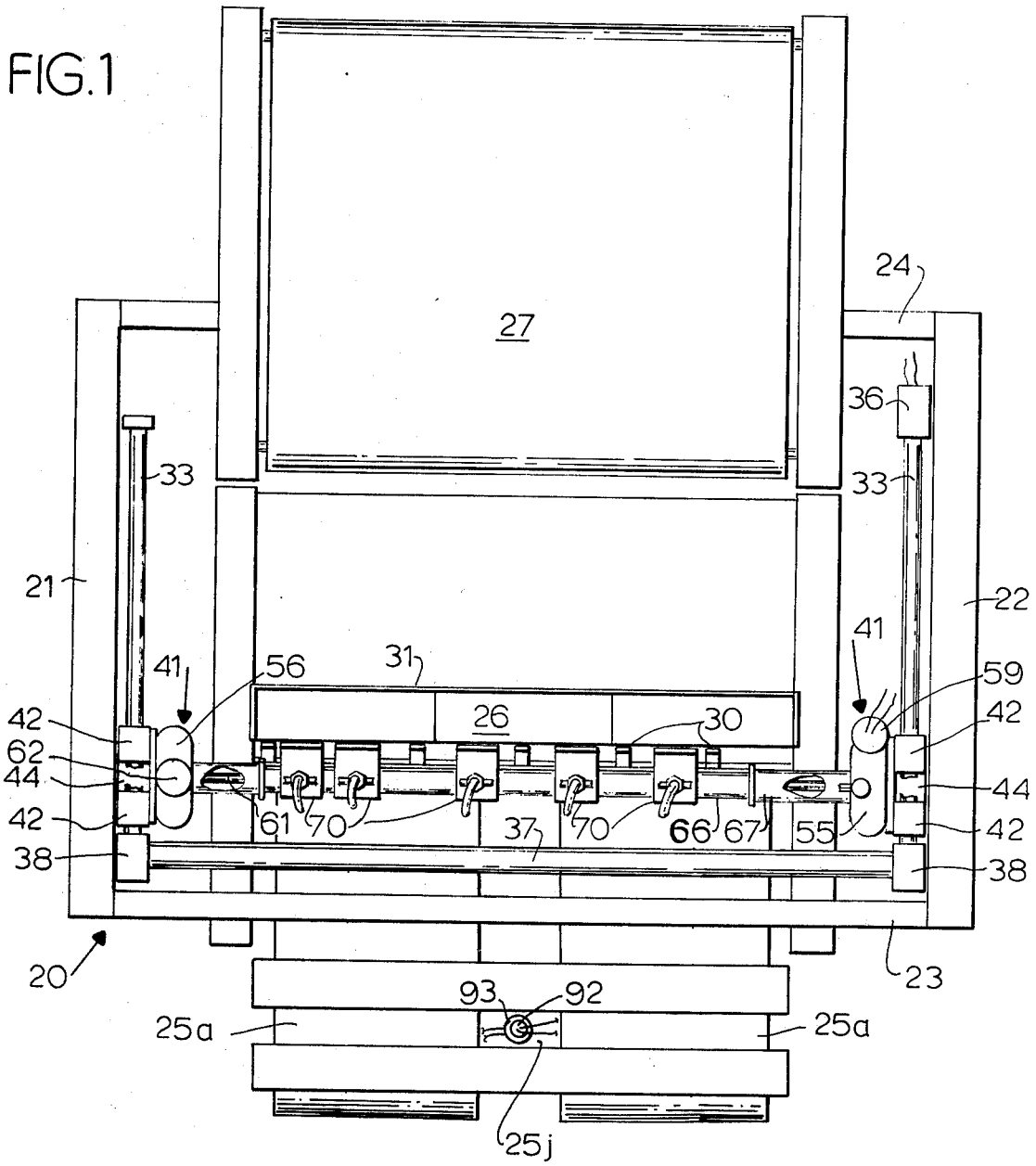

METHOD AND APPARATUS FOR MOVING A STACK OF CORRUGATED SHEETS FROM A STACKER TO A DESIRED LOCUS

BACKGROUND OF THE INVENTION

This invention relates to method and apparatus for removing a stack of corrugated sheets from a stacker and transporting them to another desired location. It can also be used for moving stacks of corrugated board in other circumstances.

A standard practice by industry for slotting and accumulating partition sheets employs a slotted cutter having a horizontal table and equipped with a recessed shuttle feed mechanism and with rotary slotting heads that are located closely adjacent to the feed mechanism. After blanks have been cut to overall size, they are stacked horizontally in a vertical stack on the feed table, and the shuttle feed slides a single blank out from beneath the stack and carries it into the cutting mechanism, where the blank is cut and slotted. After this operation, the blanks are again stacked, as by means of a curved belt which lifts the trailing edge of the slotted blank as it moves against a vertical wall, thus affording room to insert the next blank beneath the preceding one.

In the prior art, the stacked blanks have had to be moved manually from the stacking area for placement on a pallet or other suitable support, whence they are transported to an assembly machine or to a shipment point where they are shipped as a stack for later assembly.

The present invention relates to a method and machine which may be operated either manually by push button or substantially completely automatically for counting the blanks in each stack and when a predetermined number of blanks has accumulated, lifting them out from the stacker and carrying them to a moving belt or other transporting device so that they can be transported elsewhere.

The present invention eliminates both manual counting and manual removal from the stacker and results in savings in labor, as well as more accurate counting. The invention is capable of handling a wide range of material weights and various dimensions. The device needs no adjustments to change from one size to another, except when there are extreme size variations, but adjustments can be made when needed.

SUMMARY OF THE INVENTION

The apparatus of this invention practices the method of the invention. The apparatus may comprise a stationary main frame having two parallel sides with horizontal guide and support means at each side. These horizontal guide and support means may comprise a pair of smooth horizontal shafts at each side of the main frame. A carriage is supported by the horizontal guide and support means for fore-and-aft horizontal movement. The carriage may have a pair of vertical guide and support means at each end, and these also may be a pair of smooth shafts, in the case arranged vertically. The carriage includes a transverse frame with supports at each end that are slidable vertically on the vertical guide and support means. Power means may be provided for moving the carriage horizontally and the transverse frame vertically. In each instance, this power means may comprise a motor which rotates a threaded shaft lying parallel to each pair of support shafts and engages threaded means on the carriage and on the transverse frame, respectively.

The transverse frame carries a first series of vertical plates that are secured non-rotatably to the transverse frame but may be adjustable along its length. For this purpose the transverse frame may comprise two parallel shafts, one of which may be much larger and heavier than the other, the smaller and lighter shaft serving primarily for alignment. The transverse frame also supports a second series of vertical plates, which are kept in line with the first series of plates by means of a suitable support such that the second plates can be moved horizontally toward and away from the first plates. The first plates are provided with a series of forwardly projecting horizontal pins that are aligned with and can enter and pass through the perforations. The horizontal spacing of the pins and perforations is related to the spacing of the flutes of the corrugated board, and their vertical spacing is related to the thickness of the corrugated sheets. Power means is provided for moving the second plates toward and against the first plates, and at that time the pins enter into the perforations (if they are not already there) and then move through the perforations and out the other side and into the corrugated sheets for a substantial distance. However, this substantial distance need not be but a fraction of the width of the corrugated board and can be substantially less than half that width.

In operation, the pins are projected through the perforations and into the flutes of the corrugated board sheets of the stack while the sheets rest up against a series of vertical aligning end posts of the stacker. The plates are, at that time, disposed along the transverse frame in such a way that they lie between the posts and do not interfere with them, so that when the pins are projected out, they enter into the flutes of the corrugated board. They not only enter into a substantial number of the flutes of the bottommost sheet but also into a substantial number of flutes of other sheets at predetermined locations which may be selected at random, but they need not enter into all or even most of the sheets. Immediately upon entry of the pins into the flute, the transverse frame is raised to a desired height, so that the stack can be carried horizontally over the support posts of the stacker. The stack may then be moved horizontally by moving the carriage. When a desired location is reached, the stack may be lowered into a suitable position for deposit, and then the pins are stripped from the stack by use of the perforated plates, which at the same time retain the vertical alignment of the sheets themselves. After the stripping, the carriage, the transverse frame, and the plates are restored to their original position, where they are ready at a suitable time to pick up the next stack.

The device may be actuated by a mechanical or electrical counter and may operate automatically be sequencing through all the steps by use of limit switches and suitable relays or other types of master control. Alternatively, the same machine may be operated manually by pressing buttons in a desired order to achieve the same basic result.

The method of the invention, in summary, comprises the successive steps of projecting a series of pins into some of the flutes of corrugated board sheets of a stack, including a substantial number of flutes of the bottommost sheet and a substantial number of flutes in other sheets in the stack, lifting the stack to a desired height, moving the stack of corrugated board forward to a desired locus, lowering it to a desired deposit level, and retracting the pins from the flutes and stripping them from the stack while holding the end of the stack in vertical alignment.

Other objects, advantages and features of the invention will become apparent from the following description of a preferred embodiment thereof.

BRIEF DESCRIPTION OF THE DRAWINGS

In the drawings:

FIG. 1 is a top plan view of a machine embodying the principles of the invention.

FIG. 2 is a greatly enlarged fragmentary view in section showing some of the lifting pins inserted into part of a sheet of corrugated board which lies at the bottom of a stack according to the principles of this invention.

In FIG. 7 the lifting device is shown in an upper position while a stack is being formed.

In FIG. 8 the lifting device has been lowered and is in the position just previous to actuation.

In FIG. 9 the lifting device is in its actuated position, with the pins projected through the perforated plate and into some of the corrugations of the stack of corrugated board.

In FIG. 10 the lifting device has lifted a stack of corrugated boards and is about to move them to the right.

FIG. 11, in broken lines, the stack and the lifting device are shown as moved forward to a position above a conveyor belt, and in solid lines, the device is shown in the position in which the boards are actually deposited on the conveyor belt.

DESCRIPTION OF A PREFERRED EMBODIMENT

The Main Frame 20

Figure 4:
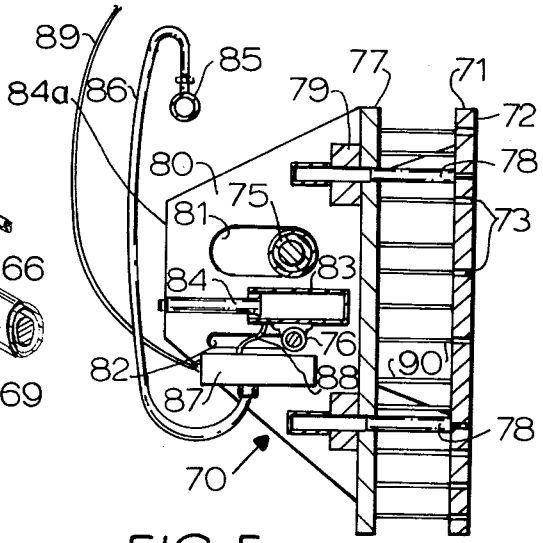
FIG. 4 is a view in side elevation and in section of a portion of the machine of FIG. 3, comprising a set of two mating plates of a pin block assembly, with the pins in their retracted position.
Figure 5:
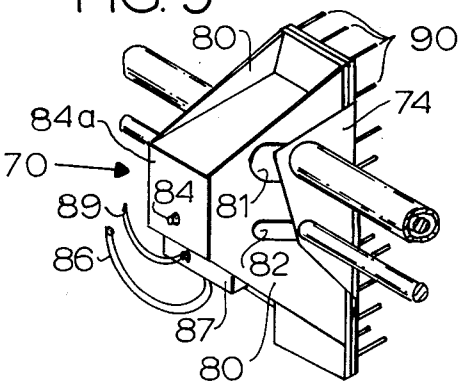
FIG. 5 is a view in rear perspective of the assembly of FIG. 4, with the pins now projected.

A machine embodying the invention, as shown in the drawings, may include a stationary main frame 20 (See FIG. 1) comprising a left side frame member 21, a right side frame member 22, andd transverse front and rear frame members 23 and 24. Extending into the front end of the frame 20 is an infeed conveyor 25 (See FIG. 13). The infeed conveyor 25 is made up of three moving conveyor belts, an upper belt **25*a* driven by rollers 25*b* and 25*c*, a lower belt 25*d* directly underlying the belt 25*a* and which is driven by rollers 25*e* and 25*f*, and a belt 25*g* which is directly in front of and slightly above the belt 25*d* and which underlies a stacker 26 and which is driven by rollers 25*h* and 25*i*. As shown in the plan view of FIG. 1, there are two belts 25*a* and two belts 26*d*, which are separated to define a vertically extending central opening 25*j*. In the opening 25*j*, a photoelectric light source 92 and a photocell detector 93 are aligned, so that the sheets 28 can be counted, one at a time, by a counter 91 connected to the detector 93, which is actuated by each interruption of the light path between the source 92 and the detector 93. (The counter 91 is more fully described in connection with the circuitry of FIG. 12 hereinafter.) Within the area enclosed by the frame 20 is the stacker 26, and above and overlying the frame 20 is an outflow conveyor 27 (See FIG. 11**).

Sheets 28 of uniformly sized corrugated paper material (See FIG. 3) are individually delivered from adjacent processing equipment such as slotter 19 to the bottom of the stacker 26 by the infeed conveyor belts **25*a*, 25*d* and 25*g* to form there a stack 29 between vertically extending end posts 30 and adjustable guide walls 31. As shown in FIG. 2, each sheet 28 includes undulating interior structure defining a series of evenly spaced flutes 32 commonly identified with corrugated paper material, be it single-faced, or double-faced as shown. In accordance with the present invention, after a stack 29 has reached a predetermined number of sheets 28, it is lifted as a stack 29 by the machine of this invention and delivered to the outflow conveyor 27**.

Figure 3:
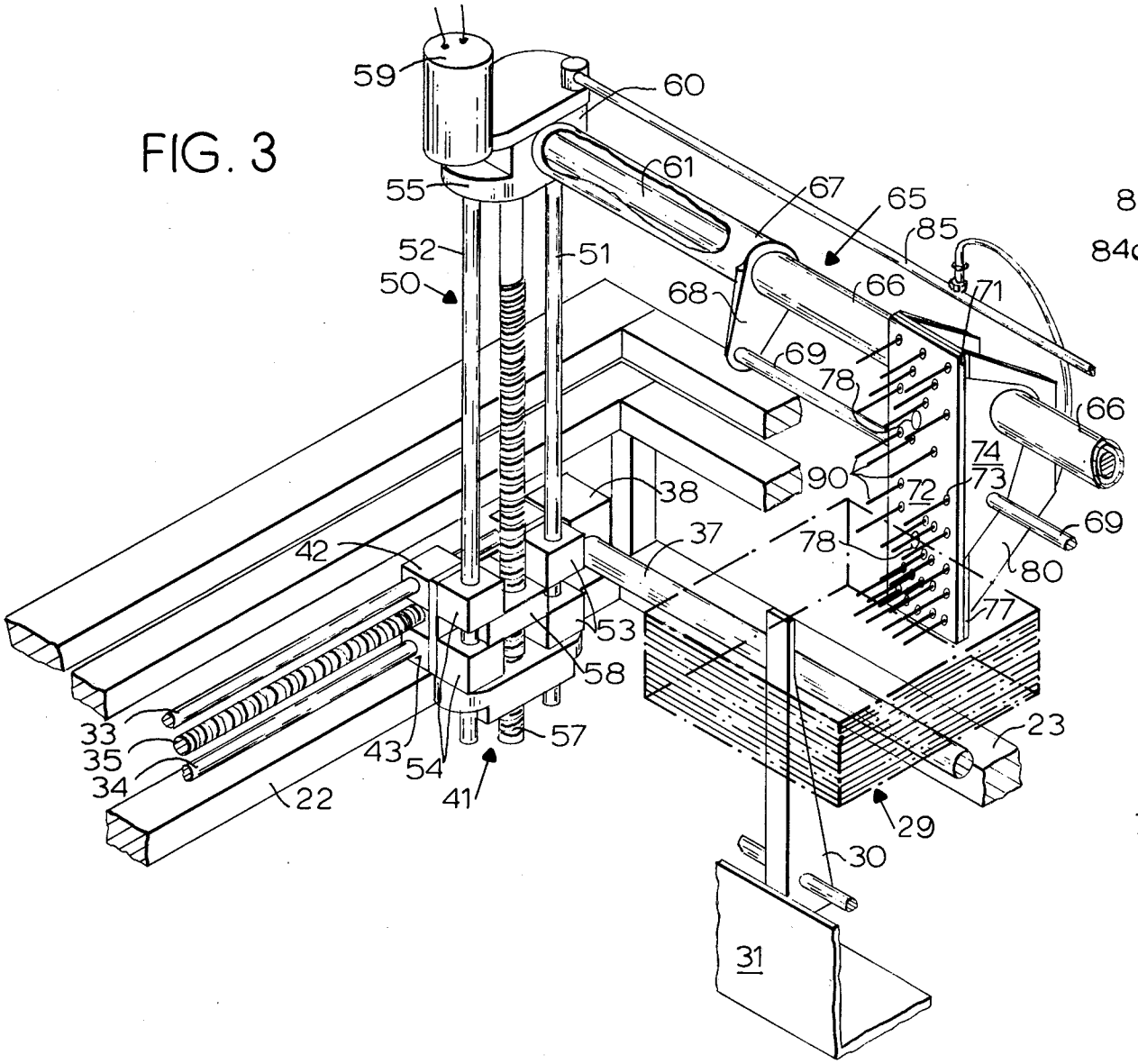
FIG. 3 is an isometric fragmentary view, partly broken away and shown in section, of one corner portion of the machine of FIG. 1.

Each side frame member 21 and 22 includes, as shown in FIG. 3, a pair of vertically aligned horizontal, stationary, smooth support shafts, an upper shaft 33 and a lower shaft 34. Between each set of shafts 33, 34 and journalled in the frame 20 is a rotatable horizontal threaded shaft 35 having acme threads or other suitable threading for moving a considerable load. Both shafts 35 are rotated by an electric motor 36, which may be directly coupled to the threaded shaft 35 on the right side and which may drive the left side threaded shaft 35 through a combination of a transverse drive shaft 37 connected between two right angle drives 38, each in turn being connected to one of the threaded shafts 35. Thus, both shafts 35 rotate in the same direction at the same rate.

The carriage 40

The horizontal shafts 33 and 34 on each side of the frame 20 support and guide a carriage 40 along a horizontal path corresponding to the length of the horizontal guide shafts 33 and 34. The carriage 40 includes slide block assemblies 41 at each side of the frame 20. Each slide block 41 has an upper horizontal bushing 42 and a lower horizontal bushing 43 which slidably engage the upper and lower horizontal guide shafts 33 and 34 respectively. Between the horizontal bushings 42 and 43 is an interiorly threaded member 44 which engages the threaded shaft 35 so that each slide block assembly 41 moves horizontally in response to the rotation of its threaded shaft 35.

The carriage 40 includes two vertical guidance and support assemblies 50, one at each side; and these in each instance, may include two vertical smooth fixed shafts 51 and 52 which slidably engage the slide block 41 with a front shaft 51 passing through a front vertical bushing 53 and a rear shaft 52 passing through a rear vertical bushing 54, both bushings being a part of the slide block 41. The uppermost ends of the vertical shafts 51 and 52 are secured within a transfer housing, there being a transfer housing 55 on the right side and a left side housing 56 (See FIG. 1). Between each set of vertical guide shafts 51 and 52 is a rotatable threaded vertical shaft 57, which is journalled in the transfer housng 55 or 56 at its uppermost end. The shaft 57 engages an interiorly threaded member 58 in the slide block 41 between the bushings 53 and 54, similarly to the engagement between the horizontal shaft 35 and its threaded member 44.

An electric drive motor 59 is mounted in the right transfer housing 55 and rotatably drives both vertical threaded shafts 57 in the same direction: through a drive box 60 for the shaft on the right side; and, through the drive box 60, a transverse drive shaft 61 and a right angle dirve 62 for the shaft 57 on the left side. When the motor 59 rotates the threaded vertical shafts 57, the vertical assemblies 50 are moved up or down, depending upon the direction of rotation of the shafts 57.

A transverse frame 65 joins the two vertical assemblies 50 together at the transfer housings 55 and 56 by a large round stationary cylindrical tube 66, having a machined exterior cylindrical surface. Within the tube 66 is the transverse drive shaft 61. Two collars 67 are mounted concentrically around the tube 6, and each collar 67 is adjustably secured at an outer end thereof to one of the transfer housings 55 or 56. Fixed to the inner ends of each collar 67 is crank-like brace 68, which secures an end of a transverse guide shaft 69 which is smaller than, is adjacently below, and is parallel to the cylindrical tube 66.

The pin block assemblies 70

A series of retracting pin block assemblies 70 is slidably mounted for longitudinal positioning on the transverse frame 65. Each assembly 70 includes a fixed plate 71 having a front planar vertical face 72 and through which multiple horizontal perforations 73 extend. The plate 71 is held in place by a pair of side flanges 74, which are joined together by two bushings 75 and 76 sized and positioned to engage the tube 66 and the guide shaft 69 respectively, so that the plate face 72 is held in a vertical orientation by adjustment of the collars 67 and guide shaft 69 relative to the tube 66; the plate 71 may be positioned longitudinally by sliding over the tube 66 and guide shaft 69 to fit in betwen the vertical posts 30 of the stacker 27. Suitable clamp means may be provided for locking the assembly 70 in a desired position along the transverse frame 65.

Each pin block assembly 70 also includes a movable plate 77 mated with the fixed plate 71 and located between the side flanges 74. The movable plate 77 is held in alignment with the fixed plate 71 by two guide pins 78 mounted on the inside of the fixed plate 71 and over which slide the movable plate 77 and its bushings 79, which are secured at the back of the plate 77. Secured to the vertical edges of the movable plate 77 and extending away from the fixed plate 71 are two side flanges 80, which are inside of and parallel with, the side flanges 74 of the fixed plate 71. The movable plate flanges 80 each have two oval openings, one opening 81 sized for the tube 66 and its bushing 75 and another smaller opening 82 sized for the guide shaft 69 and its bushing 76. Each opening has a width sufficient to enable the movable plate 77 to be moved along a horizontal path from a fully retracted position (as shown in FIG. 4) into a fully extended position (as shown in FIG. 3), wherein the movable plate 77 is immediately adjacent the fixed plate 71.

To the guide shaft bushing 76 is secured a pneumatic cylinder 83 which has a piston 84 with an exterior end joined to a rear plate **84*a* which bridges the two movable flanges 80. Compressed air is supplied to the cylinder 83 from a supply line 85, through a flexible hose 86 and through an electromagnetic two-way valve 87 and conduit 88 to actuate the cylinder 83 and thereby move the movable plate 77 along its horizontal path. An electrical control cable 89 provides controlling signals to the valve 86 to activate extension and retraction of the plate 77**.

The movable plates 77 carry a series of forwardly projecting pins 90, which are so spaced and sized that they can enter flutes 32 of the corrugated sheets 28 which the pins 90, in combination with the fixed plates 71, will lift and carry. These pins 90 are sufficiently long so that when the movable plate 77 is in its extended position (FIG. 3) the pins 90 project through the perforations 73 of the fixed plates 71 for a sufficient distance to obtain a good friction engagement within penetrated sheets of the corrugated board stack 29. The pins 90 need not be so long as to go, e.g., halfway across the sheets 28; a few inches is sufficient.

An operation cycle of the machine (FIGS. 6–11)

An operation cycle of the machine of the present invention commences with the consecutive delivery of individual corrugated sheets 28 to the bottom of the stacker 26 from a preceding stage 19 by operation of the infeed conveyor 25. As each sheet 28 passes between the conveyor belts **25*a* and 25*d* it interrupts a light path in the space 25*j* between the light source 92 and the detector 93, and each interruption causes the counter to count that sheet 28**.

Figure 9:
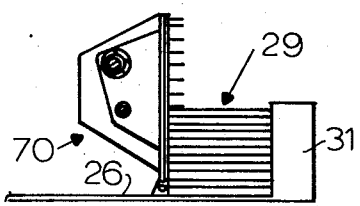
Figure 8:
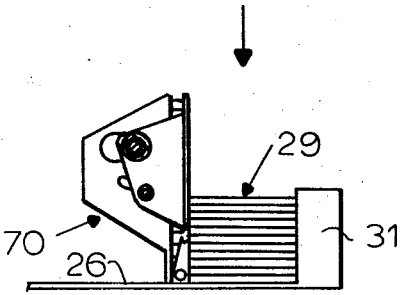
Figure 6:
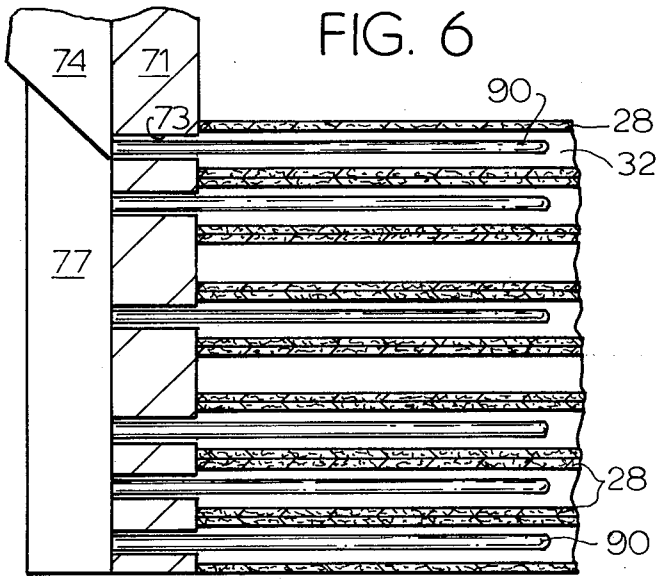
FIG. 6 is a greatly enlarged fragmentary view in elevation and in section, in detail, at right angles with respect to FIG. 2, showing the pins projecting into some of the corrugated boards of the stack.

Referring now to FIG. 8, when a stack 29 of corrugated sheets 28 has been counted and is to be lifted and transported, the pins 90 are projected through the perforations 73 into some of the flutes 32 of the stack 29, as in FIGS. 6 and 9. A substantial number of pins 90 project into the flutes 32 of the bottom sheet 28 of the stack 29 so as to engage it securely. At the same time a substantial number of other pins 92 enter at what may be practically random intervals other flutes 32 of other sheets 28 of the stack 29, not necessarily all the sheets of the stack and certainly by no means even a majority of the flutes, but a sufficient number to secure a good friction engagement to hold the stack 29 in place against the vertical faces 72 of the fixed plates 71 and to prevent sliding of the sheets 28 relative to the pins 90.

Figure 11:
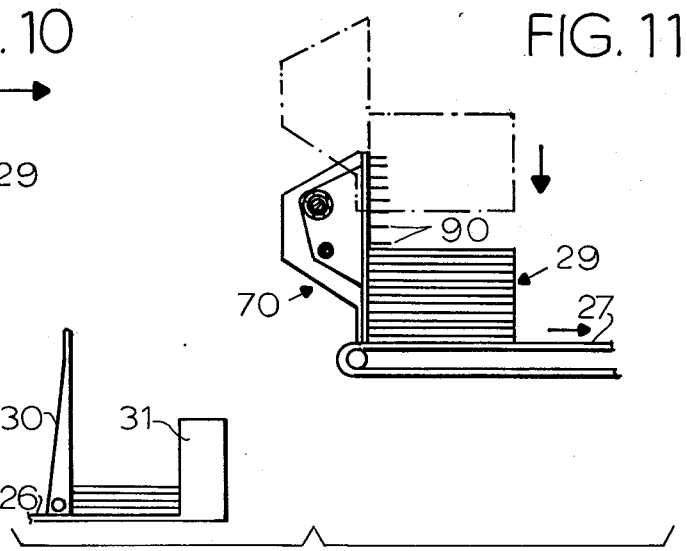
Figure 10:
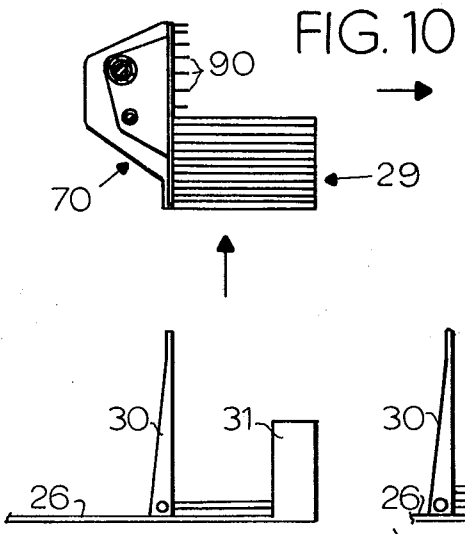

When this engagement has been obtained, the motor 59 rotates the vertical shafts 57 to lift the transverse frame 65 at least a sufficient distance to carry the stack 29 over the end posts 30 and guide walls 31 of the stacker 26 as shown in FIG. 10. Limit switches, as described later, may be employed to limit the vertical movement. Once the stack 29 has been lifted to a suitable height, the vertical movement is stopped by stopping the motor 59, and then the motor 36 is started for causing rotation of the horizontal threaded shafts 25, so that the carriage 40 moves forward to a desired position (FIG. 11, broken-line position). When this desired position is reached, this motor 36 is stopped, and then the vertical threaded shafts 57 are rotated in the opposite direction from before by their motor 59 to lower the stack 29 to a desired height. At this point, shown in solid lines in FIG. 11, the stack 29 is ready to be deposited on the outflow conveyor 27, and thereafter the compressed air cylinder 83 is used to retract the pins 90 from the flutes 32 through the perforated plates 71 to strip the stack 29 from the pins 90, the faces 72 of the perforated plates 71 engaging the end of the stack 29 and holding it in alignment.

After the stripping, the carriage 40 may be moved back to its desired position (FIG. 7) and the transverse frame 65 lowered to its desired position (FIG. 8) to locate the retracting lifter plate assemblies 70 in a suitable position for transporting the next stack 29, which has been accumulating on the stacker 26 during the just completed cycles.

Figure 12:
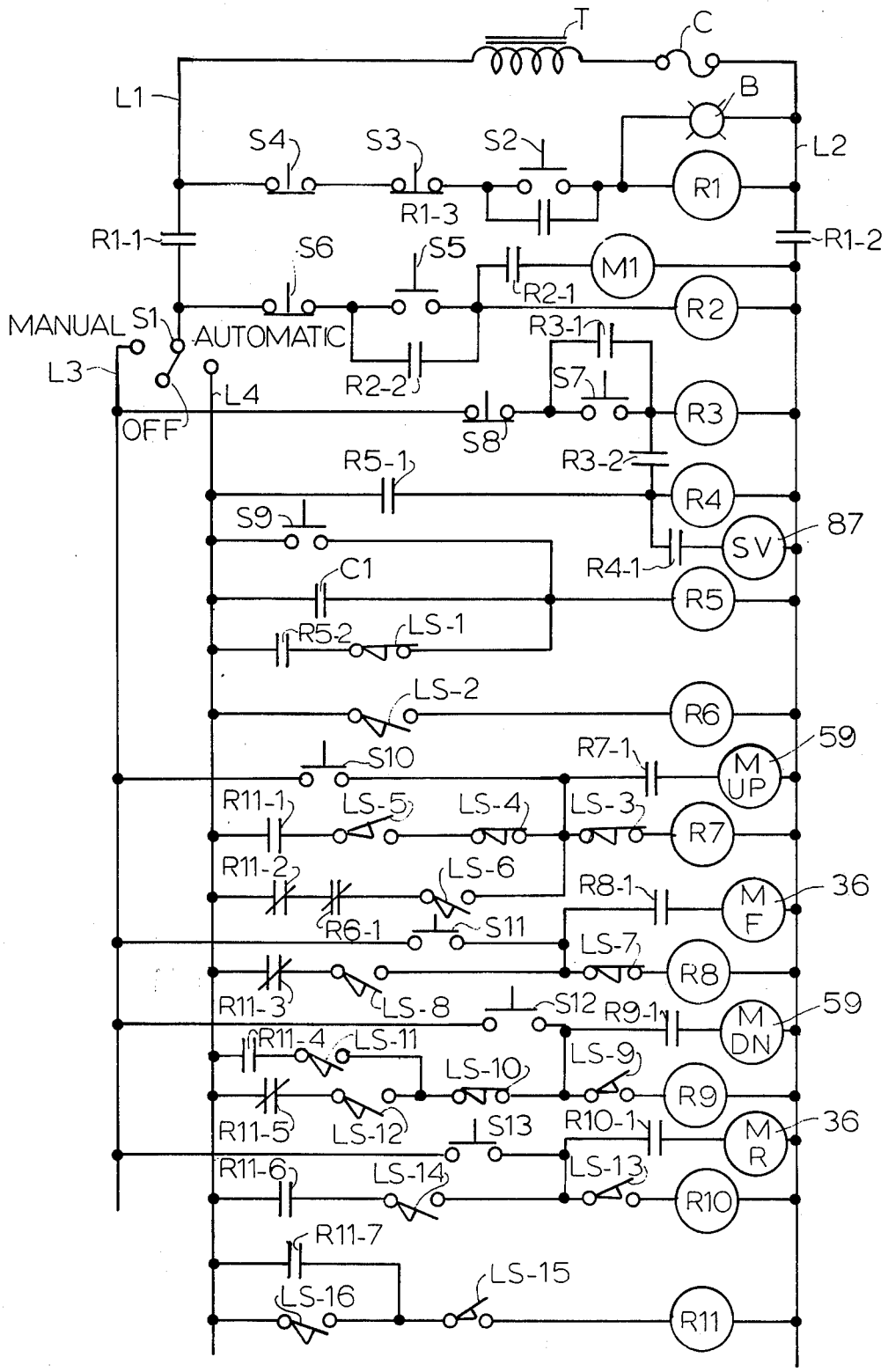
In FIG. 12 is an electrical circuit diagram of the manual and automatic control circuitry of the present invention.
Figure 13:
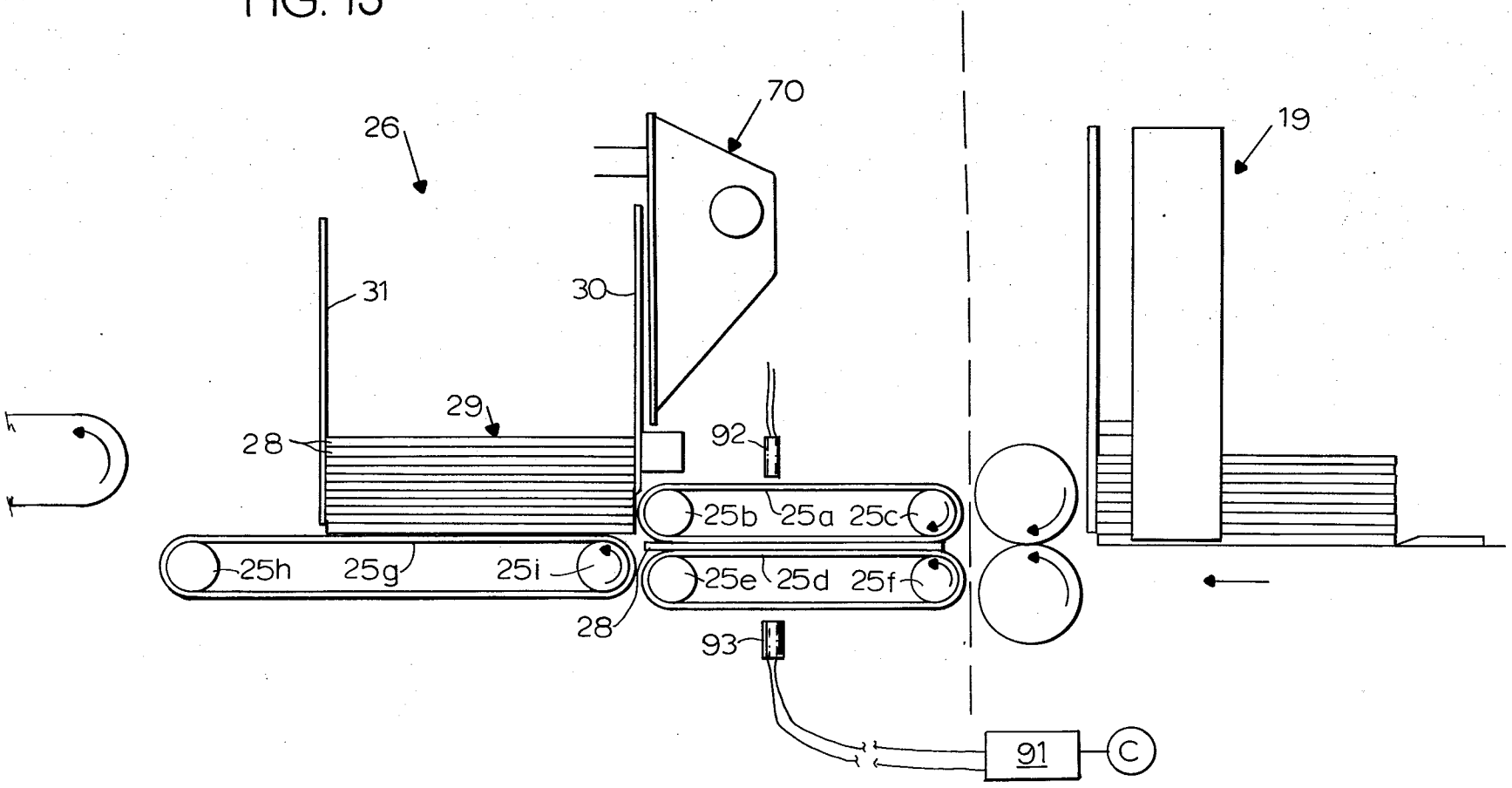
In FIG. 13 is a somewhat diagrammatic view in side elevation of an infeed conveyor subassembly for delivering corrugated sheets to the stacker from a preceding stage such as a slotter. The machine frame is omitted to add clarity to the functional description, and the take-off conveyor is broken off to save space.

The electrical circuit of FIG. 12

All this may be done manually by pressing certain buttons in sequence to actuate the motors 36 and 59 and valves 86. It may also be done automatically by employing a suitable electrical control circuit. FIG. 12 shows a circuit which enables both manual and automatic operation, and it will now be described. This electrical circuit diagram is an across-the-line diagram with a main line L1 and L2 power supply from a secondary T of a transformer. L1 terminates in a switch S1 which has three positions: an "off" position, a connection to a line L3, and a connection to a line L4. L3 is used when operating the device manually and L4 is used when operating it automatically.

A circuit breaker C is placed in series with the line L2 for overload protection. The line L2 supplies a relay R1 in parallel with a signal lamp or bulb B. The relay R1 acts, when energized, to hold closed three pairs of normally open switch contacts, R1-1, R1-2, and R1,3. The relay R1 is in series with a parallel circuit of a normally open push-button switch S2 and the contact R1-3 and with two other normally closed push-button switches S3 and S4. The switch S2 serves as a power "on" switch for the entire circuit when depressed. The switch S3 is a power "off" switch which deenergizes the relay R1, and the switch S4 is an emergency "off" switch located at a remote position to enable an operator there to turn the entire circuit off. The push-button switch S2 need be energized only momentarily to turn the power "on"; once S2 is depressed, the relay R1 remains energized via the contacts R1-3. When the relay R1 is not energized, then the contacts R1-1 and R1-2 are open and the circuit goes no further. When the relay R1 is energized, then the contacts R1-1 and R1-2 are closed, and the remainder of the circuit is in a position to be activated, depending on the position of the switch S1.

the outflow conveyor 27 is operated by a motor M1, which is controlled by contacts R2-1 of relay R2. The relay R2, when energized by momentarily pressing a push-button switch S5 is held "on" by the contacts R2-2. The relay R2 is deenergized by opening momentarily a normally closed push-button switch S6.

Continuing downwardly from the top in the diagram, the next circuit line relates only to manual operation. In this line there is a relay R3 which is in series with a manually initiated, normally open push-button switch S7 and with a manually operated, normally closed push-button switch S8. In parallel with the switch S7 are normally open contacts R3-1 of the relay R3 which operates to bridge the switch S7 and to hold the relay R3 closed. Thus, when the switch S1 is in the position connecting the line L1 to line L3, the relay R3 may be energized by momentarily pressing the push button S7. The relay R3 is then held by virtue of its contacts R3-1. Energization of the relay R3 also closes another normally open set of contacts R3-2. These serve to actuate a relay R4 which controls, via contacts R4-1, the solenoid valves 86 for the pneumatic cylinders 83 which actuate movement of the pin-carrying plates 77. Thus, pressing the push-button switch S7 when the circuit is in its manual mode, energizes the relay R4 and as a result causes the pneumatic valves 86 to be actuated to cause the pins 90 to extend through the perforations 73 and out into their flute-engaging position. When the stack 29 is to be stripped from the pins 90 in this manual mode, the switch S8 is depressed, thereby opening the relay R4 and causing the pins 90 to retract.

The relay R4 also functions in the automatic circuit, and there it is in series with normally open contacts R5-1 which are closed upon energization of a relay R5. The relay R5 also controls normally open contacts R5-2 which are series connected with a limit switch LS-1 in one of the three parallel paths connecting the line L4 to the relay R5. One of these parallel paths includes a normally open, manually actuated switch S9, which may be used to initiate the cycle of automatic operation. In the second of these three parallel paths is a set of contacts C1 of a relay C which is controlled by the counter 91 which counts the sheets 28 and energizes the relay C to close the contacts C1 when the stack 29 has reached a predetermined quantity of sheets 28.

As explained above, the counter 91 may receive a count input signal from a photoelectric detector 93 each time that the light from a light source 92 is interrupted by a sheet 28 being carried by the infeed conveyor belts 25*a* and 25*d*. The counter 91 may be a self-contained electronic counter providing an output control pulse after a predetermined number has been counted. The output pulse may be applied to the relay C, which thereupon closes the contacts C1 to achieve fully automatic operation. Alternatively, the counter 91 may be of a mechanical type which mechanically closes the contacts C1 when the predetermined count has been reached.

Once the counter 91 has momentarily closed the contacts C1 at the predetermined counted number of sheets, those contacts C1 thereupon open, and the counter begins its counting cycle over again. Once the relay R5 has been energized by the closure of the contacts C1, the relay R5 remains energized by closure of its self-holding contacts R5-2, which are in series with a normally closed limit switch LS1.

A relay R6 is in series with a normally open limit switch LS2, and when the relay R6 is energized it opens normally closed contacts R6-1, which are in the next circuit segment. In this next segment, a relay R7 controls through contacts R7-1 the vertical drive motors 59 in an upward drive mode which rotates the threaded vertical shafts 57 in the "up" direction, the direction of raising the transverse frame 65. The relay R7 is in series with a normally closed limit switch LS3, which opens at a predetermined height of the transverse frame 65. Three parallel lines are in series with the relay R7 and the limit switch LS3. Of these, the upper line shown in the diagram is a push-button switch S10, which is normally open and which is operated only in the manual mode, since it leads to the manual control power line L3. In the middle line, a normally closed pin-block limit switch LS4 in one of the retracting pin-block assemblies 70 is in series with a normally open reverse mode limit switch LS5 and normally open contacts R11-1 actuated by the relay R11 at the bottom of the diagram and still to be described. The third of these three lines includes a normally open pin-block limit switch LS6 also in one of the pin-block assemblies 70, the normally closed contacts R6-1, and normally closed contacts R11-2 which are opened by energization of the relay R11.

In the next subcircuit a relay R8 supplies power through contacts R6-1 to the horizontal drive motor 36 in a drive mode for forward movement of the carriage 40. The relay R8 is in series with a limit switch LS7, which is opened when the carriage 40 reaches a desired forward spot. The circuit element R8 and LS7 are in series with two parallel circuits, one for manual operation through a normally open manually operated push-button switch S11, and the other for automatic operation through a normally open limit switch LS8, which is actuated at the same time as the limit switch LS3 by the predetermined upper limit of the transverse frame 65. This limit switch LS8 is in series with normally closed contacts R11-3.

Controlled by the relay R11, a relay R9 operates through contacts R9-1 to reverse the direction of the vertical drive motor 59 for rotation of the shafts 57 in the opposite direction from that produced by the relay R7, that is for moving the transverse frame 65 down. The relay R9 is in series with a normally open limit switch LS9, which is closed under the circumstances that will be described below. In series with the limit switch LS9 is a manual push-button switch S12 used for manual operation and leading to the line L3. Also in series with the relay R9 and the limit switch LS9 is a limit switch LS10 which is normally closed. This leads to the line L4 via two parallel paths, the upper one of which contains in series a normally open limit switch LS11 and normally open contacts R11-4, while the lower line includes in series a normally open limit switch LS12 and normally closed contacts R11-5. The contacts R11-4 and R11-5 are opened upon energization of the relay R11.

A relay R10 reverse powers through contacts R10-1 the horizontal drive motor 36 for rotation of the shafts 35 in the opposite direction from that achieved by the relay R8. In other words, the motor 36 moves the threaded shaft to retract the carriage 40 to its initial loading position. The relay R10 is in series with a normally open limit switch LS13 and, for manual operation, the limit switch LS13 is connected to the line L3 through a normally open manually operated push-button switch S13. For automatic operation the circuit leads through a normally open limit switch LS14 in series with normally open contacts R11-6 actuated by the relay R11.

Finally, the relay R11 which function to provide a carriage-return mode lock-out, and which has been referred to several times in connection with its contacts, some of which are normally closed and some of which are normally open, is itself in series with a normally open limit switch LS15 and which is connected to the line L4 by two parallel paths, the upper one being via the normally open relay contacts R11-7 which serve to hold the relay R1 when the limit switch LS15 is closed, and the lower one being via another normally open limit switch LS16.

Manual operation of the circuit of FIG. 12

The operation of the circuit can now be considered. First, let us consider manual operation with the switch S1 connecting the line L1 to the line L3. Once the switch S2 has been momentarily closed to energize the relay R1 and to close the contacts R1-1, R1-2, and R1-3, the circuit is ready for operation. With the machine in the position of FIG. 8, the pins 90 are extended by manually closing the switch S7, which actuates the relay R3 and closes the self-holding contacts R3-1 and the contacts R3-2. Current then passes through the relay R4 and actuates, through the contacts R4-1, the solenoid valves 86. The valves 86 send air to the pneumatic cylinders 83 of the pin block assemblies 70 which force the pins 90 to their forward or extended position (FIGS. 9 and 6). When the pins 90 have been extended, the switch S10 is then manually closed, thereby energizing the relay R7 and actuating the motor 59 through the contacts R7-1 to move the transverse frame 65 up. The upward movement of the frame 65 (and therefore of the stack 29) continues until a predetermined limit is reached (FIG. 10), at which the limit switch LS3 is opened, deenergizing the relay R7 and stopping further upward movement.

In this position, the operator presses the switch S11 to cause forward movement of the carriage 40 by energizing the relay R8. When the desired forward movement of the carriage 20 (and therefore of the stack 29) is reached, the limit switch LS7 is opened, and forward movement ceases (FIG. 11, broken-line position). The operator can then move the transverse frame 65 down to lower the stack 29 to a desired position; he does this by pressing the switch S12, which actuates the relay R9 as long as he holds it down. Then when he visually determines that the desired vertical position of the transverse frame 65 has been reached, he stops the motor 59 by releasing the switch S12 (FIG. 11, solid-line position). He then opens the switch S8 to retract the pins 90 and strip them from the stack 29. The switch S8 accomplishes this by deenergizing the relay R3 and opening its contacts R3-1 and R3-2; the effect is to enable the solenoid controlled valves 86 to cause the pneumatic cylinders 83 to retract the pins 90.

To return the carriage 40 to its original position, the operator depresses the switch S10 which actuates the vertical motor 59 in the upward mode of the relay R7. When the vertical height limit switch LS3 is opened, the operator may then depress the manual switch S13 to reverse the direction of travel of the carriage 40, the limit switch LS13 having been closed automatically at the same time that the switch LS7 was opened. The carriage 40 then travels back to the position of FIG. 7, where it is automatically stopped by the opening of the reverse limit switch LS13. Then the operator presses the switch S12 again to move the transverse frame 65 down to its full down position of FIG. 8, the limit switch LS9 being automatically opened when the transverse frame 65 reaches the proper down position. The operator now can watch the counter 91, if there is a mechanical counter, for manually starting the cycle again or, if counting is done visually, he can count and actuate the machine in that manner.

Automatic operation of the circuit of FIG. 12

Automatic operation will now be considered. In this instance, the switch S1 is positioned to connect the line L1 to the line L4. The relay R1 is closed by momentarily pushing the manual start switch S2, and the outflow conveyor 27 is started by the momentary manual closure of the switch S5, as in manual operation.

In this instance, the actuation of the device does not rely on the relay R3, but it begins (See FIG. 8) with the actuation of the relay R5 by the counter 91, which at a preselected number of sheets 28 in a stack 29 automatically closes for a moment the contacts C1, thereby energizing the relay R5 and causing the closure of its contacts R5-1 and R5-2. The contacts R5-2 hold the relay R5 until the limit switch LS1 is opened. The closure of the contacts R5-1 energizes the air-controlling relay R4 which actuates the solenoid valve 86 through the contacts R4-1 to cause extension of the pins 90 of the pin block assemblies 70 (FIGS. 9 and 6). When the pins 90 are fully extended, the pin block limit switch LS4 is opened, and the pin block limit switch LS6 is also closed.

The closure of the limit switch LS6, which is in series with the normally closed contacts R6-1 and R11-2, causes energization of the relay R7, which then starts the motor 59 for upward movement of the transverse frame 65 via the series circuit of R7, LS3, LS6, R6-1, and R11-2. The initial motion upwardly of the transverse frame 65 acts to close the limit switches LS15 and LS16. When the predetermined upward travel limit is reached (FIG. 10) the limit switch LS3 is opened to stop the motor 59 and the upward movement of the frame 65; at the same time the limit switches LS14 and LS8 are closed.

Closure of the limit switch LS8 actuates the relay R8, which causes the forward movement of the carriage by its effect on the horizontal drive motor 36 through the contacts R8-1. Thus, the motor 36 is actuated by the path of R8, LS7, LS8, and the normally closed contacts R11-3. The start of the forward movement closes the limit switches LS5, LS11 and LS13.

At the predetermined forward limit (FIG. 11, broken-line position), the limit switch LS7 is opened to stop the forward drive, and at the same time the limit switch LS2 (which is in series with the relay R6) is closed, thereby energizing the relay R6, which then opens its contacts R6-1. Also, at the same time, the limit switch LS12 is closed, and the "down" operation begins, since the limit switch LS9 had previously been closed. Downward movement is achieved by the motor 59 moving in the opposite direction, as controlled by the contacts R9-1 of the relay R9, which is series-connected with the limit switches LS9, LS10, and LS12, and the closed relay contacts R11-5.

When the proper limit for this particular downward movement is reached at the solid line position of FIG. 11 (it may be termed the "down forward" position), the limit switch LS10 is opened to stop the downward movement and at the same time the limit switch LS1 is opened to deenergize the relay R5 and therefore open its contacts R5-1. As a result, the relay R4 is deenergized, the contacts R4-1 are opened, and the solenoid valves 86 are reversed, causing the pins 90 to be retracted and stripped through the perforated plates 71. At the same time, the limit switch LS16 is closed, and since the limit switch LS15 has already been closed, the carriage return mode lock-out relay R11 is energized, thereby closing its normally open contacts R11-1, R11-6, and R11-7, the latter acting as a holding relay, and also opening its normally closed contacts R11-2, R11-3, and R11-4 and R11-5. This lock-out circuit causes, as one can see, the upward-movement relay R7 to be energized, since the limit switch LS5 has been closed and the contacts R11-1 are now closed. This, again, causes upward movement of the frame 65, acting through the motor 59.

The starting of this upward movement opens the limit switches LS16, LS1 and LS10. Opening the limit switch LS1 deenergizes, again, the relay R5. Once again, the transverse frame 65 moves upwardly until the limit switch LS3 is opened to stop the upward drive, and once again, it closes the limit switches LS8 and LS14 at this point. Closure of the limit switch LS14 now starts the operation of the horizontal drive motor 36 in reverse mode by actuating the relay R10 (which supplies reverse mode power to the motor 36 via the contacts R10-1) since the limit switch LS13 is closed and the contact R11-6 has been closed. Thereby the motor 36 in reverse drive mode moves the carriage 40 back to its position of FIG. 7.

Start of the reversing drive opens the limit switch LS12 and closes the limit switch LS7, the limit switch LS2 thereby energizing the relay R6 and closing the contacts R6-1.

Figure 7:
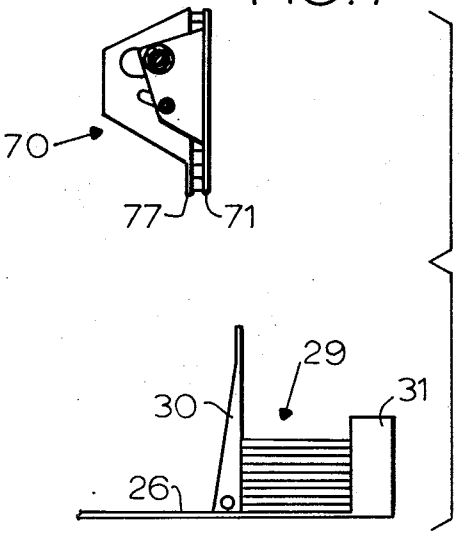
FIGS. 7 through 11 are diagrammatical views in side elevation, illustrating some of the stages of operation of the invention. A short stack is shown, as a clarifying illustration.

When the carriage 40 has been returned to its retracted position of FIG. 7 by the reverse mode operation, the limit switch LS5 is again opened as is the limit switch LS13. The opening of the limit switch LS13 stops the reverse mode movement of the motor 36 and leaves the carriage 40 in its position shown in FIG. 7. At the same time, the limit switch LS11 is closed, and, since the contacts R11-4 are now closed and the limit switches LS9 and LS10 are closed, this starts a downward movement mode of the transverse frame 65 by energizing the relay R9 to move the motor 59 in the reverse direction through the contacts R9-1. The "down" drive continues until the final downward point is reached at FIG. 8, and at that point the limit switch LS9 is opened, stopping the downward movement of the transverse frame 65 and leaving the assembly in its original position. At the same time the limit switch LS15 is also opened to deenergize the relay R11 of the reverse lockout circuit. The machine now rests in its FIG. 8 position for the completion of the count of the next stack 29, and the counter 91 initiates restart of the next cycle by closure of the contacts C1 when the new stack 29 has reached the proper count, whereupon the foregoing described control cycle is automatically repeated.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. An apparatus for relocation of a stack of corrugated board sheets aligned to expose on a side of said stack a series of many end openings for each said sheet formed by the corrugations thereof, the combination of:

an upright plate defining multiple series of horizontal perforation therethrough, one series having a multiplicity of said perforations being alignable with some of a said series of end openings of the bottom sheet of said stack and other of said series of perforations then being aligned with end openings of other sheets dispersed over said side of said stack, pin-supporting means supporting multiple series of horizontal pins, each being sized and positioned in relation to a said perforation and a said end opening for movement therethrough and for an effective distance beyond said perforation and into said opening for use in lifting said stack in cooperation with said other pins.

lift means supporting said pin-supporting means, for lifting a stack into which said pins have been inserted, and pin projecting and retracting means attached to said pin-supporting means for extending said series of pins through said plate and into a said stack and for retracting said pins from said stack.

2. Apparatus for relocation of a stack of horizontal, faced corrugated sheets having a side uniformly exposing end openings that lead into horizontal parallel passages provided by its corrugations, including in combination:

an upright plate having multiple series of horizontal perforations therethrough, one series having a multiplicity of said perforations being aligned with spaced apart openings in the bottom sheet of said stack, and other series of said perforations being aligned with openings of other sheets dispersed over said side of said stack, pin-supporting means supporting multiple series of horizontal pins, each being sized and positioned in relation to a said perforation for movement therethrough and for an effective distance into a passage of a said sheet for use in lifting said stack in cooperation with said other pins, lift means supporting said pin-supporting means, for lifting a stack into which said pins have been inserted, powered pin moving means attached to said plate and to said pin-supporting means for extending said multiple series of pins through said plate and into said stack when said plate is adjacent to said alignment means and for retracting said pins from said stack after relocation thereof.

3. The apparatus of claim 2 having powered transport means connected to said plate and to said pin-supporting means for moving said plate and said pin-supporting means together with said stack to a desired location where said stack can be deposited and the pins stripped therefrom.

4. Apparatus for relocation of a generally rectangular stack of horizontal corrugated material sheets having a side wherein edge openings into horizontal parallel passages of each said sheet are uniformly exposed, comprising in combination:

stacker means at an initial place for forming said stack in vertical alignment, an upright plate, said plate defining multiple series of horizontal perforations therethrough so spaced that when said plate is placed against said side of said stack having said edge openings, one series having a multiplicity of said perforations can be aligned with spaced apart openings in the bottom sheet of said stack and other series of said perforations are then aligned with selected openings of other sheets dispersed over said side of said stack, multiple series of horizontal pins each being sized and aligned with a said perforation for movement therethrough and into an aligned passage of said sheet for an effective distance for use in lifting said stack in cooperation with said other pins, lift means supporting said pins for lifting a said stack into which said pins have been inserted, powered pin moving means operatively connected to said plate opposite said stack and to said multiple series of pins for extending said series of pins through said plate and into said stack and for retracting said pins from said stack after relocation thereof to said delivery locus, and powered transport means connected to said plate for moving said plate away from said stacker and to a delivery locus, whereby said stack is first entered by said pins and thence lifted and carried to said delivery locus by said pins, said plate, and said transport means and deposited there and said pins stripped therefrom.

5. A machine for moving a stack of flat corrugated board sheets from a stacker to a delivery locus, said stacker having a series of vertical aligning end stacker posts, said machine comprising:

a stationary main frame with two parallel sides, each having a pair of parallel smooth shafts and a parallel rotary threaded shaft, a carriage supported by said smooth shafts for fore-and-aft horizontal movement therealong, said carriage having at each side a member threadedly engaged by said threaded shaft and having a pair of vertical end assemblies each including a pair of parallel vertical smooth shafts and a parallel rotary threaded shaft, a transverse frame extending horizontally from one said end member to the other and comprising two parallel horizontal members having at each end supports that are vertically slidable on said vertical smooth shafts and are threadedly engaged with the vertical threaded shaft, fore-and-aft power transport means for rotating said horizontal threaded shaft for moving said carriage fore-and-aft along said smooth horizontal shafts, up-and-down power lift means for rotating said vertical threaded shafts thereby raising and lowering said transverse frame along said smooth vertical shafts, a first series of vertical plates each secured for transverse movement along both said horizontal members of said transverse frame while retained against rotation relative thereto, for location at desired intervals between said posts, said vertical plates each having a series of horizontal perforations therethrough, a second series of vertical plates each mated with a respective plate of said first series for transverse movement therewith and supported by said transverse frame for fore-and-aft movement relative thereto, so that the second plates can be moved toward and away from said first plates, said second plates having a series of horizontal pins projecting therefrom at distances related to the spacing of the flutes of the corrugated board and to the thickness of the stacked sheets and aligned with said perforations through said first plates, so that as said second plates move toward and against said first plates said pins move into, through, and a substantial distance beyond said first plates, and power translating means for moving said second plates toward and against said first plates and also for moving said second plates back away from said first plates to strip said pins from a said stack.

6. A machine for moving a stack of flat corrugated board sheets from a stacker to a delivery locus, said stacker having a series of vertical aligning end stacker posts, said machine comprising:

a stationary main frame having two parallel sides with horizontal guide-and-support means at each said side a carriage supported by said horizontal guide-and-support means for fore-and-aft horizontal rectilineal movement therealong, said carriage having a pair of vertical guide-and-support means at each end and a transverse frame with supports at each end that are vertically slidable on said vertical guide-and-support means, power transport means for moving said carriage fore and aft, up-and-down power lift means for raising and lowering said transverse member, a first series of vertical plates secured non-rotatably to said transverse frame member and having a series of horizontal perforations therethrough, a second series of vertical plates supported for fore-and-aft translation by said transverse frame and in alignment with respective plates of said first series so that said second plates can be moved toward and away from said first plates, said second plates having a series of horizontal pins projecting forwardly therefrom and spaced apart by predetermined distances, laterally corresponding to a multiple of the spacing of the flutes of the corrugated board and vertically corresponding to the sheet thickness, said pins being aligned with said perforations of said first plates, so that as said second plates move toward and against said first plates said pins move into, through, and a substantial distance out beyond said first plates, and translating means for moving said second plates toward and against said first plates and also for moving said second plates back away from said first plates to strip said pins therefrom, whereby when a desired number of corrugated board sheets are stacked, said translation means is actuated to move said second plates toward and against said first plates, so as to project said pins into some of the flutes of said corrugated board sheets, including a substantial number of flutes of the bottom sheet and a substantial number of flutes in other sheets in said stack, whereupon said transverse frame is lifted to a desired height by said up-and-down power lift means, and then at said desired height said fore-and-aft power transport means moves said carriage to carry said stack of corrugated board sheets to a desired locus and then lowers it to a desired level by said up-and-down power lift means, whereupon said translating means retracts said secondplates from said first plates, thereby retracting said pins from said flutes and stripping them from said stack, while said first plates hold said stack in alignment, said carriage then being returned to its position adjacent said stacker by said fore-and-aft power transport means and said up-and-down lift means.

7. A machine for moving a stack of flat corrugated board sheets from a stacker having a series of vertical aligning end stacker posts and carrying the stack to a delivery locus, including in combination;

frame means for supporting said stack, said frame means having horizontal guide-and-support means, carriage means supported by said horizontal guide-and-support means for moving said stack from said stacker to said delivery locus, power transport means for moving said carriage means along said horizontal guide-and-support means, lift means for raising and lowering at least a portion of said carriage means relative to said horizontal guide-and-support means, a series of vertical plates secured to said carriage means and having a series of horizontal perforations therethrough, a series of horizontal pins spaced apart by predetermined distances, laterally related to the spacing of the flutes of the corrugated board and vertically related to the sheet thickness, said pins being sized and aligned to move through said perforations of said plates and therebeyond for a substantial distance, controlled translating means securing said pins on one side of said plates for extending said pins through and beyond said plates and for retracting said pins, and circuitry connected between a power source and said transport means, said lift means, and said translating means for controlling said machine, whereby when a desired number of corrugated board sheets are stacked, said translation means is actuated to move said pins through said plates and beyond, so as to project said pins into some of the flutes of said corrugated board sheets, including a substantial number of flutes of the bottom sheet and a substantial number of flutes of other sheets in said stack, whereupon said carriage means is lifted to a desired height by said power lift means, and then at said desired height said power transport means moves said carriage means to carry said stack of corrugated board sheets to a desired locus and then lowers it to a desired level by said power lift means, whereupon said translating means retracts said pins from said flutes so as to strip them from said stack, while said plates hold said stack in alignment, said carraige means then being returned to original position by said fore-and-aft power transport means and said up-and-down power lift means.

8. The machine of claim 7 wherein said translating means includes a series of pin-securing plates supported for fore-and-aft translation by said carriage means and in alignment with respective said vertical plates so that said pin-securing plates can be moved toward and away from said vertical plates.

9. The machine of claim 7 wherein said carriage means includes a transverse frame member carrying said translating means and to which each vertical plate of said series is adjustably fixed.

10. The machine of claim 7 including counter means at said stacker connected to control said circuitry of said machine for actuating said translating means to extend said pins into said sheets when a said stack reaches a predetermined desired number of said sheets.

11. The machine of claim 10 wherein said counter means includes a counter positioned at said stacker to count each sheet upon delivery thereof to said stack, to activate through said circuitry said translating means when the count reaches said predetermined number and thereupon to reset itself and commence counting a subsequent stack.

12. The machine of claim 10 wherein said translating means includes switch means connected to said circuitry for stacking said lift means in a mode for elevation of said carriage means when said pins have extended beyond said plates for engagement of a said stack.

13. The machine of claim 7 wherein said circuitry automatically controls operation and includes:

a. stack engagement control means for activating said translating means to extend said pins when a desired number of sheets are stacked, b. forward carriage lift control means for activating said lift means in a mode for lifting said carriage means when said pins have been fully extended into said stack, c. first vertical limit control means for stopping said lift means in said lifting mode when said carriage means achieves a predetermined height and thereupon starting said power transport means in a mode for forward movement of said carriage means, d. forward limit control means for stopping said transport means in said forward mode when said carriage means reaches a predetermined forward limit, and thence starting said power lift means in a mode for lowering said carriage toward said delivery locus, e. delivery locus detection means for stopping said power lift means in said lowering mode when said delivery locus is reached and activating said translation means to retract said pins, thereby stripping them from said stack and thereby delivering said stack, f. carriage means return means for starting said lift means in a mode for lifting said carriage means upon retraction of said pins, g. carriage means reverse control means for stopping said lift means in said lift mode when said predetermined height is reached by said carriage means and then starting said power transport means in a mode for reverse movement of said carriage means, h. carriage means lower control means for stopping said transport means in said reverse mode when said carriage means has returned to its initial lateral position on said horizontal guide-and-support means and starting said lift means in a mode for lowering said carriage means into initial placement adjacent said stacker, and i. carriage means stop control means for stopping said lift means in said lowering mode when said carriage means has reached its loading position at said stacker.

14. A method for moving a stack of a desired number of corrugated board sheets having multiple internal flutes from a stacker to another location, comprising the successive steps of projecting multiple series of pins into some of the flutes opening on an aligned side of the stack of said corrugated board sheets, including one series into a substantial number of flutes of the bottom sheet and other series into a substantial number of flutes in other sheets in said stack, lifting said stack to a desired height, moving said stack of corrugated board forward to a desired locus, lowering it to a desired deposit level, and retracting said series of pins from said flutes and stripping them from said stack while maintaining said aligned side of the stack in vertical alignment.

15. The method of claim 14 including, before the projecting step, the step of counting said sheets in said stacker to determine when said desired number of sheets thereof is reached and thereupon commencing said pin projecting step.

16. The method of claim 15 wherein each said successive step is automatically commenced upon completion of said immediately preceding step and further comprising the step of returning said pins to said stacker upon completion of said retracting step.

17. A method for moving a stack of a desired number of corrugated board sheets having multiple internal flutes opening at an end of said stack from a stacker to another location, comprising the successive steps of:

counting said sheets during stacking, upon said counter reaching a predetermined number, automatically projecting multiple series of pins at said end of said stack into some of the flutes of said corrugated board sheets, including one series into a substantial number of flutes of the bottom sheet and other series into a substantial number of flutes in other sheets in said stack, upon completion of said projection step, automatically lifting said stack to a desired height, upon reaching said desired height, automatically moving said stack of corrugated board forward to a desired locus, upon said stack reaching said locus, automatically lowering it to a desired deposit level, upon said stack reaching said deposit level, automatically retracting said multiple series of pins from said flutes and stripping them from said stack while holding the end of the stack in vertical alignment, upon completion of said retracting step, automatically returning said pins to a position adjacent said stacker for beginning the cycle over again when the counter next reaches said predetermined number.

* * * * *